US011454934B2

(12) United States Patent
Born

(10) Patent No.: US 11,454,934 B2
(45) Date of Patent: Sep. 27, 2022

(54) SHOCK PROTECTION FOR A STRIP RESONATOR WITH RCC PIVOTS

(71) Applicant: The Swatch Group Research and Development Ltd, Marin (CH)

(72) Inventor: Jean-Jacques Born, Morges (CH)

(73) Assignee: The Swatch Group Research and Development Ltd, Marin (CH)

( * ) Notice: Subject to any disclaimer, the term of this patent is extended or adjusted under 35 U.S.C. 154(b) by 815 days.

(21) Appl. No.: 16/372,768

(22) Filed: Apr. 2, 2019

(65) Prior Publication Data

US 2019/0332057 A1 Oct. 31, 2019

(30) Foreign Application Priority Data

Apr. 27, 2018 (EP) ..... 18169741

(51) Int. Cl.
*G04B 17/04* (2006.01)

(52) U.S. Cl.
CPC ..... *G04B 17/045* (2013.01)

(58) Field of Classification Search
CPC ..... G04B 17/045
See application file for complete search history.

(56) References Cited

U.S. PATENT DOCUMENTS

2012/0106303 A1* 5/2012 Von Gunten ..... G04B 17/066 368/175
2015/0023140 A1* 1/2015 Daout ..... G04B 1/14 368/177
2016/0091862 A1* 3/2016 Born ..... G04B 17/32 368/168

(Continued)

FOREIGN PATENT DOCUMENTS

CH 705967 A1 * 7/2013 ..... G04B 17/045
CH 711 573 A2 3/2017

(Continued)

OTHER PUBLICATIONS

Combined Chinese Office Action and Search Report dated Sep. 3, 2020 in Chinese Patent Application No. 201910334372.0 (with English translation of Categories of Cited Documents), 7 pages.

(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

A timepiece resonator mechanism including a structure and an inertia element oscillating about an axis, subjected to return forces exerted by a RCC flexure pivot with elastic resonator strips, which are each fixed to the structure and to the inertia element and essentially deformable in a plane perpendicular to the axis, straight and extending in parallel or coincident planes, the crossing, in projection onto a plane perpendicular to the axis, of their directions defining this axis, these strips are fixed on the inertia element side to a stiff element, comprised in an anti-shock element and on which are fixed the strips and which is integral with anti-shock flexible elements arranged to keep suspended the inertia element, the anti-shock element providing shock protection for the strips of the flexure pivot.

22 Claims, 3 Drawing Sheets

(56) References Cited

U.S. PATENT DOCUMENTS

| | | | | |
|---|---|---|---|---|
| 2016/0124389 | A1* | 5/2016 | Lechot | G04B 31/04 368/322 |
| 2016/0179058 | A1* | 6/2016 | Born | G04B 17/04 368/167 |
| 2016/0223989 | A1 | 8/2016 | Winkler et al. | |
| 2016/0370763 | A1* | 12/2016 | Cusin | G04B 17/34 |
| 2017/0227930 | A1* | 8/2017 | Di Domenico | G04B 15/02 |
| 2017/0322517 | A1 | 11/2017 | Semon et al. | |
| 2018/0136607 | A1* | 5/2018 | Lechot | G04B 43/002 |

FOREIGN PATENT DOCUMENTS

| | | |
|---|---|---|
| EP | 3 021 174 A1 | 5/2016 |
| EP | 3 054 357 A1 | 8/2016 |

OTHER PUBLICATIONS

European Search Report dated Nov. 15, 2018 in European Application 18169741.8, filed on Apr. 27, 2018 (with English translation of categories of Cited Documents).

* cited by examiner

SHOCK PROTECTION FOR A STRIP RESONATOR WITH RCC PIVOTS

CROSS-REFERENCE TO RELATED APPLICATION

This application claims priority to European Patent Application No. 18169741.8 filed on Apr. 27, 2018, the entire disclosure of which is hereby incorporated herein by reference.

FIELD OF THE INVENTION

The invention concerns a timepiece resonator mechanism, comprising a structure and at least one inertia element arranged to oscillate in a pivoting motion about a pivot axis, with the centre of inertia of this at least one inertia element aligned on the pivot axis, this at least one inertia element being subjected to return forces exerted by at least one RCC flexure pivot comprising a plurality of elastic resonator strips, each directly or indirectly fixed at a first end to the structure and directly or indirectly fixed at a second end to said at least one inertia element, each elastic resonator strip extending in a plane perpendicular to the pivot axis, and being essentially deformable in the plane perpendicular to the pivot axis, wherein the elastic resonator strips are straight and extend in planes that are parallel to each other or coincident, and wherein the crossing, in projection onto a plane perpendicular to the pivot axis, of the directions in which the elastic resonator strips extend, defines the pivot axis.

The invention also concerns an oscillator including at least one such resonator mechanism and an escapement mechanism.

The invention also concerns a timepiece movement including at least one such oscillator and/or one at least one such resonator mechanism.

The invention also concerns a watch including such a timepiece movement and/or at least one such oscillator and/or at least one such resonator mechanism.

The invention concerns the field of timepiece resonators and more particularly those that include elastic resonator strips acting as return means for operation of the oscillator.

BACKGROUND OF THE INVENTION

Shock resistance is a difficult issue for most timepiece oscillators, and in particular for crossed strip resonators. Indeed, during out-of-plane impact, the stress experienced by the strips rapidly reaches very high values, which, accordingly, reduces the travel that the part can make before yielding.

Shock absorbers for timepieces are available in many variants. However, their function, essentially, is to protect the fragile pivots of the arbor, and not the elastic elements, such as, conventionally, the balance spring.

European Patent Application No. EPEP3054357A1 in the name of ETA Manufacture Horlogère Suisse discloses a timepiece oscillator including a structure and distinct primary resonators, which are temporally and geometrically offset, each comprising a weight returned towards the structure by an elastic return means. This oscillator includes coupling means for the interaction between the primary resonators, including driving means for driving motion of a wheel set which includes driving and guiding means arranged to drive and guide a control means articulated to transmission means, each articulated, at a distance from the control means, to a weight of a primary resonator. The primary resonators and wheel set are arranged such that the articulation axes of any two primary resonators and the articulation axis of the control means are never coplanar.

European Patent Application EP3035127A1 in the name of SWATCH GROUP RESEARCH & DEVELOPMENT Ltd discloses a timepiece oscillator comprising a resonator formed by a tuning fork, which includes at least two mobile oscillating parts, fixed to a connection element by flexible elements whose geometry determines a virtual pivot axis of determined position with respect to a plate, and about which oscillates the respective mobile part, whose centre of mass coincides in the rest position with the respective virtual pivot axis.

For at least one moving part, the flexible elements are formed of crossed elastic strips at a distance from each other in two parallel planes, and whose directions, in projection onto one of the parallel planes, intersect at said virtual pivot axis of the moving part.

Swiss Patent Application No CH711573A2 in the name of PATEK PHILIPPE discloses a timepiece movement comprising a frame and a mechanism mounted in or on the frame, the mechanism comprising a flexure bearing system comprising a securing part and a moving part connected by elastic bearing parts. The flexure bearing system is located at least partly in an aperture of a frame element and is fixed by the securing part to the lateral wall of said aperture.

European Patent Application No. EP3021174A1 in the name of LVMH discloses a monolithic timepiece regulator made in a single plate, including a stiff external element, a stiff internal element, and elastic suspension members connecting the stiff external element to the stiff internal element and allowing oscillating rotational movements therebetween. The stiff internal element has arms which are rigidly connected to one another, leaving angular spaces free therebetween and the suspension members are situated in these free angular spaces.

SUMMARY OF THE INVENTION

The invention proposes to protect the strips of a strip resonator with RCC (remote centre of compliance) flexure pivots and thus to ensure better performance of the system.

To this end, the invention concerns a strip resonator mechanism according to claim 1.

The invention also concerns an oscillator including at least one such resonator mechanism and an escapement mechanism.

The invention also concerns a timepiece movement including at least one such oscillator and/or one at least one such resonator mechanism.

The invention also concerns a watch including such a timepiece movement and/or at least one such oscillator and/or at least one such resonator mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

The invention proposes to protect the strips of a strip resonator with RCC (remote centre of compliance) flexure pivots and thus to ensure better performance of the system.

Swiss Patent Application No. CH01511/16 in the name of Swatch Group Research & Development Ltd discloses anti shock devices for head-to-tail V-shaped flexure pivots and for RCC flexure pivots. This Application requires numerous banking arrangements which are advantageous for such mechanisms, easy to implement for those skilled in the art in combination with the disclosure of the present description, and which are not set out in detail again here.

It is to be noted that a head-to-tail V-shaped pivot arrangement has the advantage of juxtaposing four strips, at least one of which can bend or buckle to prevent breakage of the assembly.

The situation is more difficult for an impact occurring on an RCC pivot, since, if the direction of impact is parallel to one of the strips and tends to elongate the strip which is very stiff, the latter may break in the event of excessive elongation. The invention therefore proposes to provide a simple solution to this particular case.

To this end, the invention consists in introducing at least one anti shock element between the strips of the RCC pivot and the inertia element.

Thus, the invention concerns a timepiece resonator mechanism 100, comprising a structure 1 and at least one inertia element 2, which is arranged to oscillate in a pivoting motion about a pivot axis D. The centre of inertia of this at least one inertia element 2 is aligned on pivot axis D during oscillation.

Figure 1:
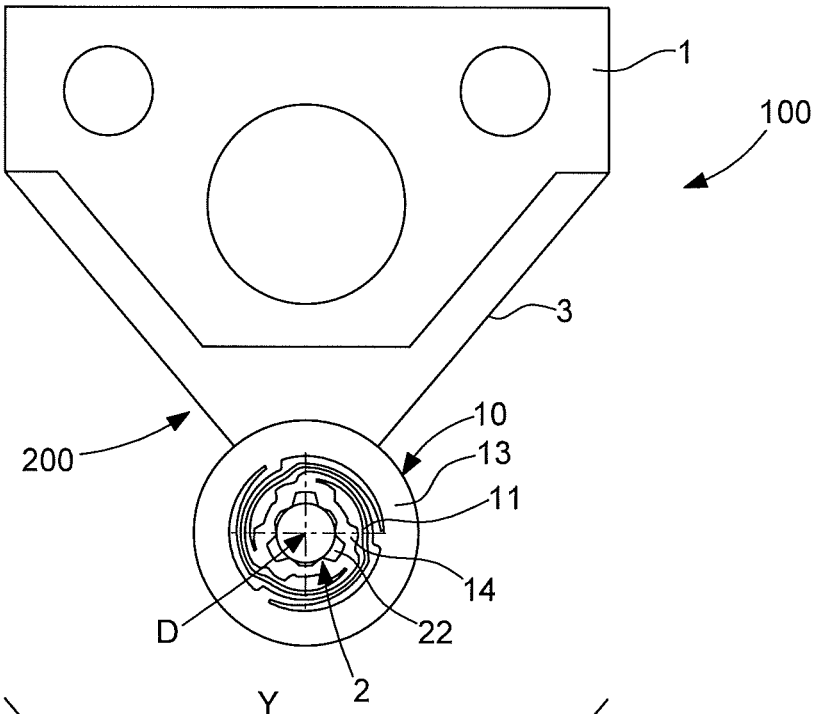
FIG. 1 represents a partial, schematic plan view of a resonator mechanism with elastic resonator strips, with an RCC flexure pivot, and comprising at the end of the elastic resonator strips of this RCC pivot, an anti shock element according to the invention, in which is held an inertia weight arbor (not represented).
Figure 2:
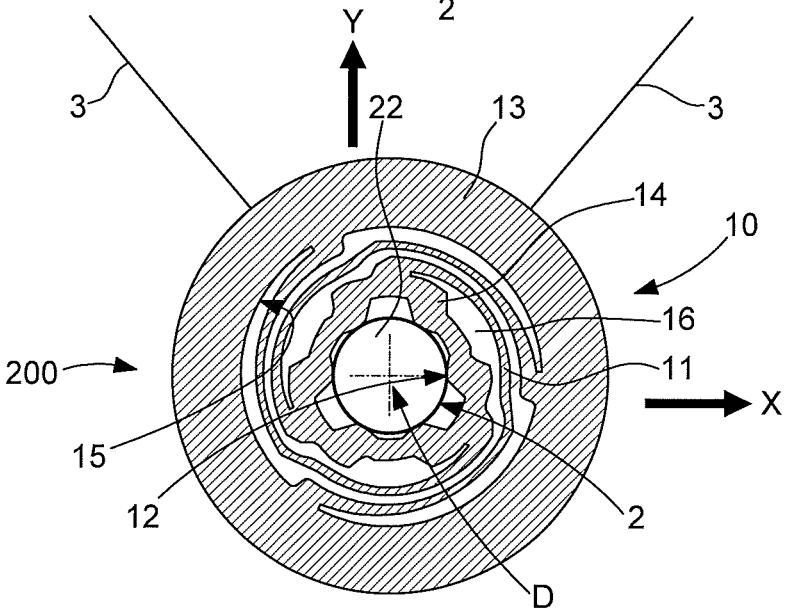
FIG. 2 is a detail of this anti shock element, which includes a substantially annular stiff external element to which is suspended an elastic internal element, via three anti shock flexible strips which provide the shock protection for the RCC pivot; more particularly but not exclusively, this inner ring clamps the inertia weight arbor.
Figure 6:
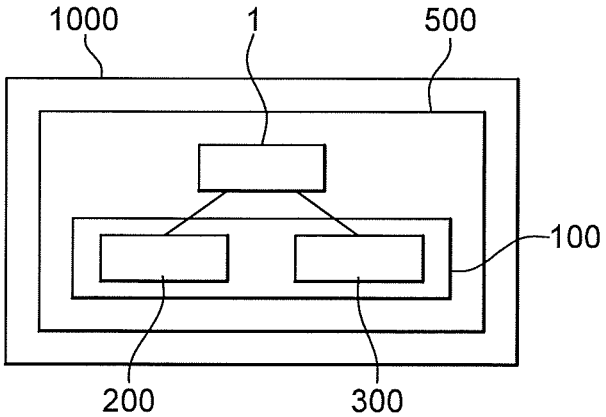
FIG. 6 is a block diagram representing a watch including a movement comprising an oscillator which in turn includes a resonator mechanism according to the invention.
Figure 3:
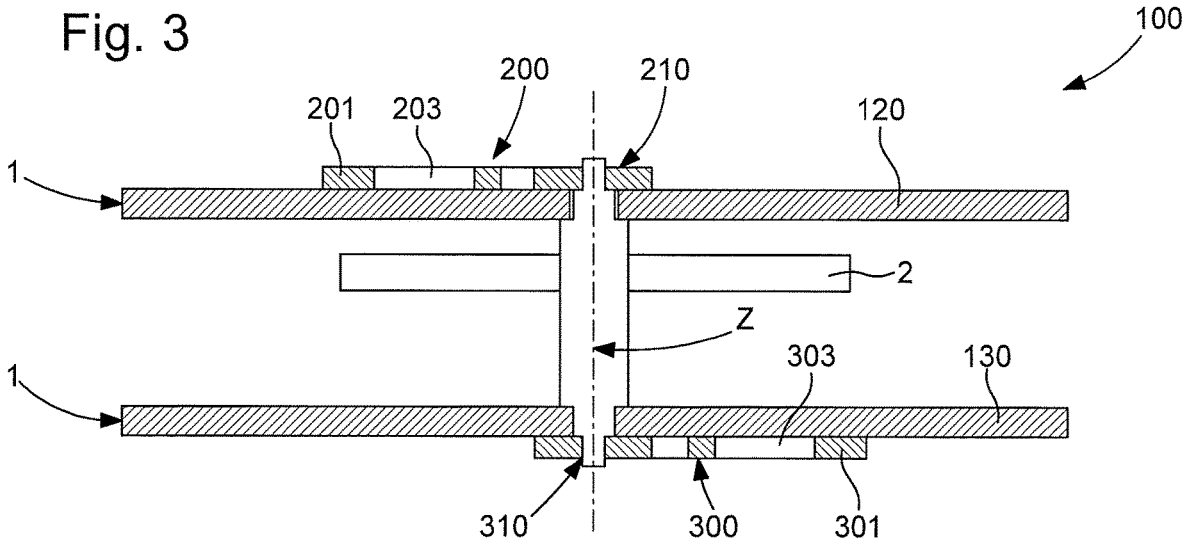
FIGS. 3 and 4 schematically represent, respectively, an axial sectional view and a top view of an assembly with two RCC pivots placed face-to-face: an upper pivot above a bridge and a lower pivot below a plate, each clamping one end of the inertia weight arbor, which is situated between the bridge and the plate.
Figure 4:
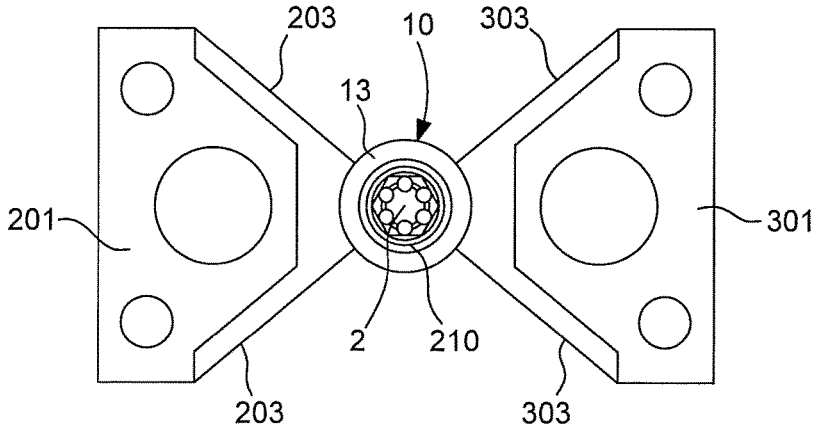

This at least one inertia element 2 is subjected to return forces exerted by at least one RCC flexure pivot referenced 200 in FIGS. 1 and 2, and 201 and 301 in FIGS. 3 and 4. This flexure pivot 200, 201, 301 includes a plurality of elastic resonator strips 3. Each of these strips 3 is directly or indirectly fixed at a first end to structure 1 and is directly or indirectly fixed at a second end to at least one inertia element 2. Each elastic resonator strip 3 extends in a plane perpendicular to pivot axis D and is deformable essentially in the plane perpendicular to pivot axis D. Preferably but not exclusively, elastic resonator strips 3 are straight. These elastic resonator strips 3 extend in planes that are parallel to each other or coincident, and wherein the crossing, in projection onto a plane perpendicular to pivot axis D, of directions D1; D2 in which elastic resonator strips 3 extend, defines pivot axis D.

According to the invention, resonator mechanism 100 includes an anti-shock element 10, which includes a stiff element 13, on which are fixed the second ends of strips 3 and which is integral with at least one anti-shock strip 11 arranged to keep inertia element 2 suspended. This anti-shock element 10 provides shock protection for strips 3 of flexure pivot 200, 201, 301.

This stiff element 13 includes a chamber 16, which is delimited by an inner surface 15, to which is secured inside chamber 16 at least one such anti-shock flexible strip 11 arranged to keep an inner ring 14 suspended. This inner ring 14, thus suspended in stiff element 13, carries inertia element 2, or carries an arbor 22 comprised in inertia element 2.

The arrangement of the at least one anti-shock flexible strip 11, particularly a plurality of anti-shock flexible strips 11 as seen in FIGS. 1 and 2, is arranged to allow any radial motion with respect to pivot axis D, or any paraxial motion, in a plane perpendicular to pivot axis D, of inner ring 14 within the confines of chamber 16, so as to prevent any rotation of stiff element 13 when inertia element 2 is subjected to the acceleration of an impact, anti-shock element 10 thus providing shock protection for strips 3 of flexure pivot 200, 201, 301. "Paraxial motion" means that inner ring 14 moves parallel to its orientation at rest, without rotating, along one of axes X or Y of FIG. 2, in the plane of the image, which is perpendicular to pivot axis D.

The fact that inner ring 14 is prevented from rotating ensures that anti-shock flexible strips 11 cannot disrupt operation of resonator mechanism 100.

The radial or paraxial travel of inner ring 14 can go to the stop position in contact with inner surface 15 of chamber 16 when the arrangement of anti-shock flexible strips 11 allows direct contact; if the arrangement of anti-shock flexible strips 11 does not allow direct contact between inner ring 14 and inner surface 15, as in the particular and non-limiting variant of FIGS. 1 and 2, inner ring 14 can go up to the stop position in contact with at least one of anti-shock flexible strips 11; more particularly, these anti-shock flexible strips 11 can go up to the stop position in contact with inner surface 15 of chamber 16, as in FIGS. 1 and 2, wherein inner ring 14 can go up to the stop position in contact with at least one anti-shock flexible strip which is itself in abutment in contact with inner surface 15.

More particularly, stiff element 13 is at least 100 times stiffer, in every degree of freedom, than elastic resonator strips 3 of the flexure pivot, and than each anti-shock flexible strip 11 comprised in anti-shock elastic element 10.

Different arrangements of anti-shock flexible strips 11 are possible.

In a first variant, at least one anti-shock flexible strip 11 and more particularly each anti-shock flexible strip 11 is substantially coiled around pivot axis D.

In a second variant, each anti-shock flexible strip 11 is substantially of revolution around pivot axis D.

More particularly, anti-shock element 10 includes a plurality of identical anti-shock flexible strips 11, regularly distributed around pivot axis D.

In an advantageous embodiment seen in FIGS. 1 and 2, anti-shock element 10 includes an elastic inner ring 14, to which is internally fixed each anti-shock flexible strip 11, which is externally fixed to stiff element 13, which is substantially annular, and to which is suspended elastic inner ring 14. Elastic inner ring 14 more particularly includes a plurality of internal shoulders 12 for concentric clamping of an arbor 22 of inertial element 2.

Advantageously, anti-shock flexible strips 11 are calculated such that the rotational resonance frequency of anti-shock element 10 in its first natural mode is higher than 1000 Hz, or than several thousand Hz.

On the flexure pivot side, the oscillation frequency of inertia element 2 is more particularly comprised between 5 Hz and 100 Hz.

An assembly with two RCC pivots placed face-to-face makes it possible to:

cancel out the effects of position, during wear, on the resonator frequency; the centre of mass of the inertia weight must be equidistant from the RCC pivots;

stiffen the system and limit the movements of the inertia weight to rotation along the Z axis which corresponds to pivot axis D.

Thus, this at least one inertia element 2 is subjected to return forces exerted by a pair of identical RCC flexure pivots 201, 301, mounted face-to-face, and wherein all of strips 3 are fixed at their second end to a single, common anti-shock element 10.

The centre of mass of the inertia element is equidistant from the pivot axes of RCC flexure pivots 201, 301 when these axes are distinct, or aligned therewith when they are coaxial.

FIGS. 3 and 4 illustrate a particular non-limiting case wherein the RCC flexure pivots 201, 301 of the pair are arranged in parallel planes, on either side of inertia element 2. More particularly, these RCC flexure pivots 201, 301 of the pair are arranged on either side of two fixed elements of structure 1, between which inertia element 2 can move.

Figure 7:
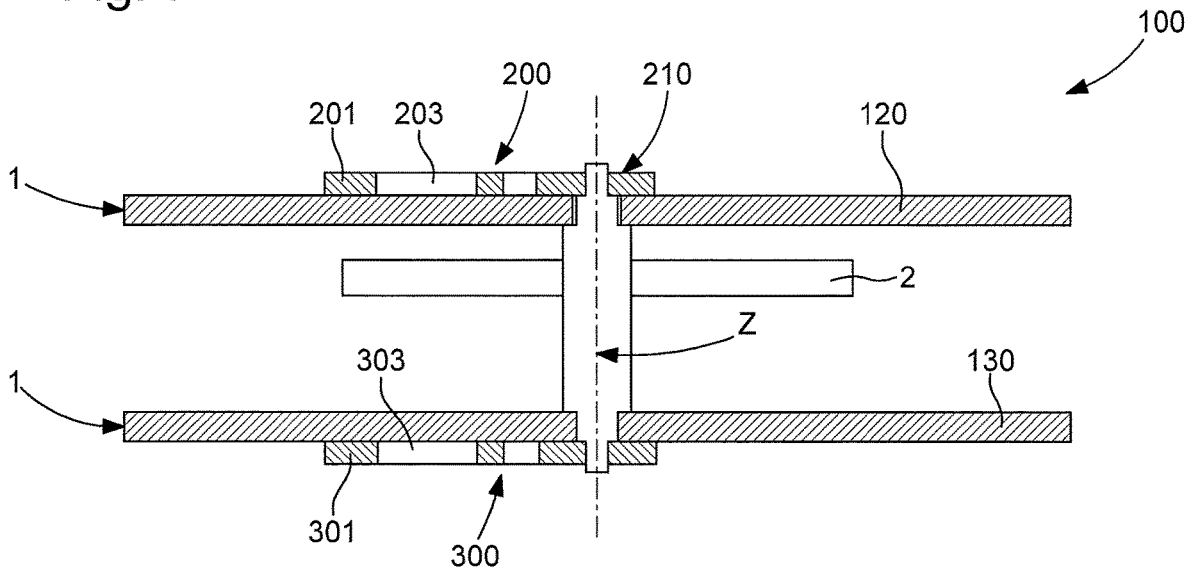
FIGS. 7 and 8 represent, in a similar manner respectively to FIGS. 3 and 4, a variant assembly with two superposed RCC pivots, which are also arranged on either side of the plate and the bridge.
Figure 8:
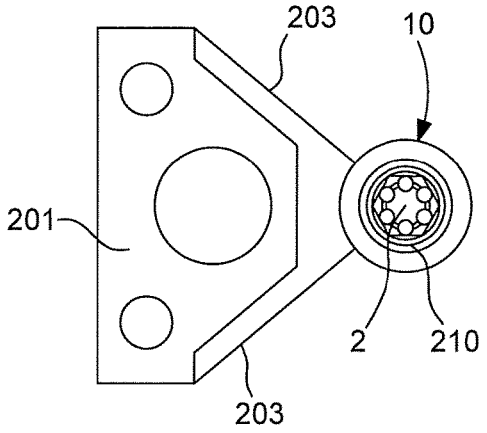

FIGS. 7 and 8 represent, in a similar manner respectively to FIGS. 3 and 4, a variant assembly with two superposed RCC pivots, which are also arranged on either side of the plate and the bridge.

In a variant, in anti-shock element 10, at least one anti-shock flexible strip 11 is arranged to hold and elastically clamp inertia element 2. More particularly, anti-shock element 10 includes a plurality of anti-shock flexible strips 11, each arranged to hold and elastically clamp inertia element 2.

It can be said that, for the same inertia weight:

the rotational stiffness (resonance frequency of the system) of strips 11 is at least 100 times and more particularly at least 500 times, and more particularly still at least 1000 times greater than the stiffness of strips 3, in order not to disturb the resonance frequency;

the translational stiffness (resonance frequency of the system) in the plane of strips 11 is at least 100 times and more particularly at least 500 times, and more particularly still at least 1000 times lower than the stiffness of strips 3, in order to ensure movement in case of impact.

As regards the translational stiffness in direction Z of strips 11 and of strips 3, said stiffness is such that, in case of impact, both strips 11 and strips 3 participate in displacement of the inertia weight to the stop position.

More particularly, resonator mechanism 100 includes axial stop means comprising at least one lower axial stop and/or one upper axial stop, the axial stop means being arranged to abuttingly engage with at least one inertia element 2 in order to protect resonator mechanism 100 against axial impacts in the direction of pivot axis D.

The various arrangements of Swiss Patent Application No. CH01511/16 can advantageously be incorporated in this mechanism.

Figure 5:
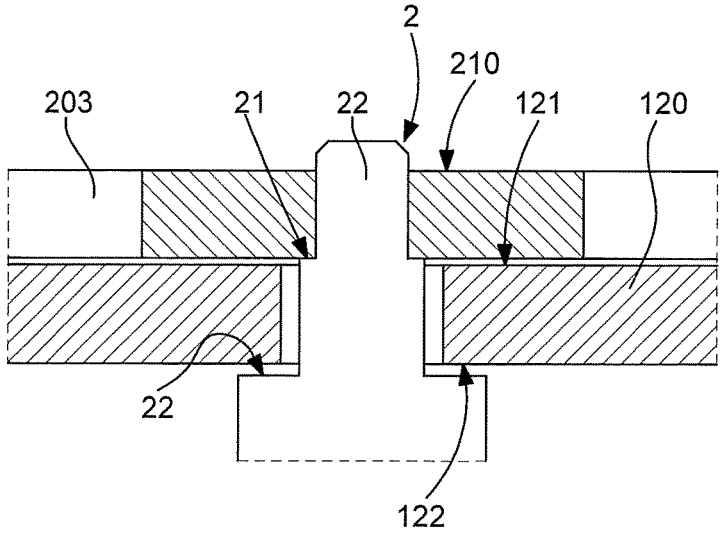
FIG. 5 represents a schematic axial sectional view of a detail of FIG. 3 at the upper pivot.

FIG. 3 illustrates a particular case with an upper RCC pivot 200 with strips 203, with a fixed part 201 on the upper side of a bridge 120, comprised in structure 1, with stops in proximity to an upper pivot 210 of an arbor 22 of inertia element 2; the latter is confined between this bridge 120 and a plate 130 of structure 1, under which is secured fixed part 301 of a lower RCC pivot 300 with strips 303. On each side, anti-shock element 10, which extends elastic resonator strips 3 and which is not shown in detail in FIG. 5, is designed to move into abutment on a shoulder 21 of arbor 22, at a distance from the corresponding surface 121 of bridge 120 (or respectively of plate 13), and this arbor 22 includes, on the side of inertia element 2, a shoulder at a distance from underside 122 of bridge 120 (or respectively of plate 130).

In a variant that is not illustrated, resonator mechanism 100 includes a plurality of such inertia elements 2 which extend over several parallel levels and resonator mechanism 100 includes at least one intermediate axial stop arranged between two adjacent levels of inertia elements 2.

The invention also concerns an oscillator 400 including such a resonator mechanism 100, arranged to cooperate with an escapement mechanism 300.

The invention also concerns a timepiece movement 500 including at least one such oscillator 400 and/or at least one such resonator mechanism 100.

The invention also concerns a watch 1000 including at least one such movement 500, and/or at least one such oscillator 400, and/or at least one such resonator mechanism 100.

The invention claimed is:

1. A timepiece resonator mechanism comprising:

a structure and at least one inertia element, which is arranged to oscillate in a pivoting motion about a pivot axis, with the centre of inertia of said at least one inertia element aligned on said pivot axis, said at least one inertia element being subjected to return forces exerted by first and second remote centre of compliance (RCC) flexure pivots, each of said flexure pivots comprising a plurality of elastic resonator strips, each of said elastic resonator strips directly or indirectly fixed at a first end to said structure and directly or indirectly fixed at a second end to said at least one inertia element, each said elastic resonator strip extending in a plane perpendicular to said pivot axis and being essentially deformable in said plane perpendicular to said pivot axis, wherein said elastic resonator strips are straight and extend in planes that are parallel to each other or coincident, wherein a crossing, in projection onto a plane perpendicular to said pivot axis, of directions in which said elastic resonator strips extend, defines said pivot axis, and wherein said resonator mechanism includes an anti-shock element which includes a stiff element, on which are fixed said second ends of said strips, and which includes a chamber delimited by an inner surface to which is fixed inside said chamber at least one anti-shock flexible strip arranged to keep suspended an inner ring carrying an arbor comprised in said inertia element such that said arbor extends through an opening in said structure, a first shoulder on a first end of the arbor includes a first shoulder in abutment with said first flexure pivot, and a second shoulder on a second end of the arbor includes a second shoulder in abutment with said second flexure pivot, so as to allow any radial motion with respect to said pivot axis or paraxial motion in a plane perpendicular to said pivot axis of said inner ring within the confines of said chamber, so as to prevent any rotation of said stiff element when said inertia element is subjected to acceleration from an impact, said anti-shock element providing shock protection for said strips of said flexure pivots.

2. The resonator mechanism according to claim 1, wherein said stiff element is at least 100 times stiffer, in every degree of freedom, than said elastic resonator strips of said flexure pivots, and than each said anti-shock flexible strip comprised in said anti-shock elastic element.

3. The resonator mechanism according to claim 1, wherein each said anti-shock flexible strip is substantially coiled around said pivot axis.

4. The resonator mechanism according to claim 1, wherein each said anti-shock flexible strip is substantially of revolution about said pivot axis.

5. The resonator mechanism according to claim 1, wherein said anti-shock element comprises a plurality of identical said anti-shock flexible strips regularly distributed around said pivot axis.

6. The resonator mechanism according to claim 1, wherein said anti-shock element comprises an elastic inner ring, to which is internally fixed each said anti-shock flexible strip, which is externally fixed to said stiff element, which is substantially annular and to which is suspended said elastic inner ring, and wherein said elastic inner ring includes a plurality of internal shoulders for the holding and concentric clamping of an arbor of said inertia element.

7. The resonator mechanism according to claim 1, wherein the rotational resonance frequency of said anti-shock element in its first natural mode is higher than 1000 Hz.

8. The resonator mechanism according to claim 1, wherein the oscillation frequency of said inertia element is comprised between 5 Hz and 100 Hz.

9. The resonator mechanism according to claim 1, wherein said first and second flexure pivots are a pair of identical said RCC flexure pivots, mounted face-to-face, and wherein all of said strips are fixed at the second end thereof to a single, common, anti-shock element.

10. The resonator mechanism according to claim 9, wherein the centre of mass of said inertia element is equidistant from the pivot axes of said RCC flexure pivots when said axes are distinct, or aligned therewith when they are coaxial.

11. The resonator mechanism according to claim 9, wherein said RCC flexure pivots of said pair are arranged in parallel planes, on either side of said inertia element.

12. The resonator mechanism according to claim 11, wherein said RCC flexure pivots of said pair are arranged on either side of the two fixed elements of said structure, between which said inertia element can move.

13. The resonator mechanism according to claim 1, wherein at least one said anti-shock flexible strip is arranged to hold and elastically clamp said inertia element.

14. The resonator mechanism according to claim 1, wherein said anti-shock element includes a plurality of anti-shock flexible strips, each arranged to hold and elastically clamp said inertia element.

15. The resonator mechanism according to claim 1, wherein said resonator mechanism comprises axial stop means comprising at least one lower axial stop and/or one upper axial stop, said axial stop means being arranged to abuttingly engage with at least one said inertia element in order to protect said resonator mechanism against axial impacts in the direction of said pivot axis.

16. The resonator mechanism according to claim 1, wherein said resonator mechanism comprises a plurality of said inertia elements which extend over several parallel levels, and wherein said resonator mechanism includes at least one intermediate axial stop arranged between two adjacent levels of said inertia elements.

17. An oscillator comprising a resonator mechanism according to claim 1, arranged to cooperate with an escapement mechanism.

18. A timepiece movement comprising at least one oscillator according to claim 17.

19. The timepiece movement comprising at least one resonator mechanism according to claim 1.

20. A watch comprising at least one movement according to claim 18.

21. The resonator mechanism according to claim 1, wherein the opening in said structure has a smaller diameter than a maximum diameter of the arbor in a portion of the arbor between the first shoulder and the second shoulder.

22. The resonator mechanism according to claim 1, wherein the portion of the structure that immediately surrounds the opening in said structure is located between said first flexure pivot and said second flexure pivot in a direction parallel to said pivot axis.

* * * * *